US007383828B2

(12) United States Patent
Eriksson et al.

(10) Patent No.: US 7,383,828 B2
(45) Date of Patent: Jun. 10, 2008

(54) METHOD AND APPARATUS FOR USE IN ENHANCING FUELS

(75) Inventors: Johannes Eriksson, San Diego, CA (US); Erik Ulsteen, San Diego, CA (US); Richard Rahe, Orange, CA (US)

(73) Assignee: Emission & Power Solutions, Inc., Carlsbad, CA (US)

( * ) Notice: Subject to any disclaimer, the term of this patent is extended or adjusted under 35 U.S.C. 154(b) by 224 days.

(21) Appl. No.: 11/140,474

(22) Filed: May 27, 2005

(65) Prior Publication Data

US 2005/0287025 A1 Dec. 29, 2005

Related U.S. Application Data

(60) Provisional application No. 60/663,553, filed on Mar. 18, 2005, provisional application No. 60/667,720, filed on Apr. 1, 2005, provisional application No. 60/582,419, filed on Jun. 24, 2004, provisional application No. 60/582,514, filed on Jun. 24, 2004.

(51) Int. Cl.
*F02M 27/00* (2006.01)

(52) U.S. Cl. ..... 123/538

(58) Field of Classification Search ..... 123/536–538
See application file for complete search history.

(56) References Cited

U.S. PATENT DOCUMENTS

| | | | |
|---|---|---|---|
| 3,616,375 | A | 10/1971 | Inoue |
| 3,764,008 | A | 10/1973 | Darley et al. |
| 3,996,012 | A | 12/1976 | Zucker |
| 4,009,095 | A | 2/1977 | Carson |
| 4,282,100 | A | 8/1981 | Kunishio et al. |
| 4,332,667 | A | 6/1982 | Epperly et al. |
| 4,356,078 | A | 10/1982 | Heavin et al. |
| 4,358,373 | A | 11/1982 | Jubenville |
| 4,369,100 | A | 1/1983 | Sawyer |
| 4,421,629 | A | 12/1983 | York et al. |

(Continued)

FOREIGN PATENT DOCUMENTS

| | | |
|---|---|---|
| CA | 2211561 | 8/1996 |

(Continued)

OTHER PUBLICATIONS

Kidwell-Ross, "Engine Damage From Low Sulphur Diesel Fuel", American Sweeper, Oct. 3, 2002, 3 pages, vol. 3, No. 1.

(Continued)

*Primary Examiner*—M. McMahon
(74) *Attorney, Agent, or Firm*—Fitch Even Tabin & Flannery

(57) ABSTRACT

The present embodiments provide methods and apparatuses for use in enhancing and/or treating fluids, such as fuels. Some embodiments provide apparatuses for use in treating fuel that comprise a first conduit having an input end, an output end, and a metallic interior surface; a second conduit positioned within and axially aligned with the first conduit, the second conduit having input and output ends, and a plurality of apertures distributed along a length of the second conduit; and an impeller assembly comprising an impeller positioned between an adaptor sleeve and shaft support where at least the impeller and shaft support are fixed within the second conduit, and the adaptor sleeve is positioned at the input end of the second conduit.

18 Claims, 12 Drawing Sheets

U.S. PATENT DOCUMENTS

| | | | | | |
|---|---|---|---|---|---|
| 4,443,322 | A | | 4/1984 | Jubenville | |
| 4,488,866 | A | | 12/1984 | Schirmer et al. | |
| 4,492,674 | A | | 1/1985 | Schweighardt | |
| 4,561,953 | A | | 12/1985 | Muralidhara et al. | |
| 4,639,309 | A | | 1/1987 | Lalancette et al. | |
| 4,715,325 | A | * | 12/1987 | Walker | 123/1 A |
| 4,747,920 | A | | 5/1988 | Muralidhara et al. | |
| 4,765,885 | A | | 8/1988 | Sadeghi et al. | |
| 4,810,359 | A | | 3/1989 | Sayles | |
| 4,820,422 | A | | 4/1989 | Spencer | |
| 4,891,131 | A | | 1/1990 | Sadeghi et al. | |
| 4,930,483 | A | * | 6/1990 | Jones | 123/538 |
| 4,931,171 | A | | 6/1990 | Piotter | |
| 5,017,281 | A | | 5/1991 | Sadeghi et al. | |
| 5,019,219 | A | | 5/1991 | Hamer et al. | |
| 5,048,499 | A | | 9/1991 | Daywalt | |
| 5,062,944 | A | | 11/1991 | Lieb et al. | |
| 5,098,553 | A | | 3/1992 | Sapre | |
| 5,110,443 | A | | 5/1992 | Gregoli et al. | |
| 5,120,428 | A | | 6/1992 | Ikura et al. | |
| 5,167,782 | A | * | 12/1992 | Marlow | 204/168 |
| 5,197,446 | A | | 3/1993 | Daywalt et al. | |
| 5,198,122 | A | | 3/1993 | Koszalka et al. | |
| 5,209,879 | A | | 5/1993 | Redding, Jr. | |
| 5,213,619 | A | | 5/1993 | Jackson et al. | |
| 5,254,177 | A | | 10/1993 | Chauvin | |
| 5,307,779 | A | * | 5/1994 | Wood et al. | 123/538 |
| 5,314,613 | A | | 5/1994 | Russo | |
| 5,403,475 | A | | 4/1995 | Allen | |
| 5,423,979 | A | | 6/1995 | Allen | |
| 5,470,458 | A | | 11/1995 | Ripley et al. | |
| 5,472,620 | A | | 12/1995 | Huang | |
| 5,482,629 | A | | 1/1996 | Rippetoe et al. | |
| 5,485,883 | A | | 1/1996 | Rippetoe et al. | |
| 5,494,585 | A | | 2/1996 | Cox | |
| 5,538,081 | A | | 7/1996 | Rippetoe et al. | |
| 5,547,563 | A | | 8/1996 | Stowe | |
| 5,554,301 | A | | 9/1996 | Rippetoe et al. | |
| 5,584,969 | A | | 12/1996 | Nagai et al. | |
| 5,679,236 | A | | 10/1997 | Poschl | |
| 5,690,811 | A | | 11/1997 | Davis et al. | |
| 5,824,214 | A | | 10/1998 | Paul et al. | |
| 5,881,702 | A | | 3/1999 | Arkfeld | |
| 5,914,027 | A | | 6/1999 | Ellingsen | |
| 5,969,207 | A | | 10/1999 | Kozyuk | |
| 6,019,947 | A | | 2/2000 | Kucherov | |
| 6,036,849 | A | | 3/2000 | Rippetoe et al. | |
| 6,074,549 | A | | 6/2000 | Bacon Cochrane et al. | |
| 6,106,699 | A | | 8/2000 | MacDonald et al. | |
| 6,106,787 | A | | 8/2000 | Rippetoe et al. | |
| 6,110,359 | A | | 8/2000 | Davis et al. | |
| 6,142,127 | A | | 11/2000 | Maass | |
| 6,171,476 | B1 | | 1/2001 | Draemel et al. | |
| 6,190,538 | B1 | | 2/2001 | Gosselink et al. | |
| 6,402,939 | B1 | | 6/2002 | Yen et al. | |
| 6,405,719 | B2 | | 6/2002 | Nozato | |
| 6,446,612 | B1 | | 9/2002 | Hankins et al. | |
| 6,454,936 | B1 | | 9/2002 | Varadaraj | |
| 6,527,960 | B1 | | 3/2003 | Bacon et al. | |
| 6,544,411 | B2 | | 4/2003 | Varadaraj | |
| 6,555,009 | B2 | | 4/2003 | Varadaraj | |
| 6,627,784 | B2 | | 9/2003 | Hudson et al. | |
| 2002/0005346 | A1 | | 1/2002 | Babington | |
| 2002/0043478 | A1 | | 4/2002 | Draemel et al. | |
| 2002/0125174 | A1 | | 9/2002 | Varadaraj | |
| 2002/0164274 | A1 | | 11/2002 | Haggett et al. | |
| 2003/0019791 | A1 | | 1/2003 | Austin | |
| 2003/0042174 | A1 | | 3/2003 | Austin | |
| 2003/0051989 | A1 | | 3/2003 | Austin | |
| 2003/0102251 | A1 | | 6/2003 | Draemel et al. | |
| 2003/0102255 | A1 | | 6/2003 | Mahajan | |
| 2003/0132139 | A1 | | 7/2003 | Varadaraj | |

FOREIGN PATENT DOCUMENTS

| | | |
|---|---|---|
| CA | 2222842 | 1/1997 |
| DE | 4107708 | 9/1992 |
| JP | 59102988 | 12/1982 |
| JP | 60223893 | 4/1984 |
| JP | 60226594 | 4/1984 |
| JP | 6384633 | 9/1986 |
| WO | WO9622946 | 8/1996 |
| WO | WO9702404 | 1/1997 |

OTHER PUBLICATIONS

Katz et al., Cavitation and Multiphase Flow, 1995, vol. 210, The American Society of Mechanical Engineers, New York, NY.
Office Action from U.S. Appl. No. 11/140,507, dated May 24, 2006.
Office Action from U.S. Appl. No. 11/140,507, dated Dec. 12, 2006.
Office Action from U.S. Appl. No. 11/140,507, dated Sep. 13, 2007.
Patent Cooperation Treaty, "International Preliminary Report on Patentability," for corresponding PCT Application No. PCT/US2005/022868, dated Mar. 27, 2007, 5 pages.

* cited by examiner

METHOD AND APPARATUS FOR USE IN ENHANCING FUELS

PRIORITY CLAIM

This application claims the benefit of U.S. Provisional Application Nos. 60/663,553, filed Mar. 18, 2005, entitled METHOD AND APPARATUS FOR USE IN ENHANCING FUELS; 60/667,720, filed Apr. 1, 2005, entitled METHOD, APPARATUS AND SYSTEM FOR USE IN ENHANCING FUELS; 60/582,419, FILED Jun. 24, 2004, entitled METHOD AND APPARATUS FOR THE ENHANCEMENTS OF DIESEL FUELS; and 60/582,514, filed Jun. 24, 2004, entitled METHOD AND APPARATUS FOR THE ENHANCEMENTS FOR GASOLINE, all of which are incorporated herein by reference in their entirety.

FIELD OF THE INVENTION

The present invention relates generally to the treatment of fuels, and more particularly to the enhancement of fuels.

BACKGROUND

The number of combustion engines in use today is in excess of hundreds of millions of engines. These combustion engines typically operate through the ignition and combustion of fuels such as fossil fuels. Many of the vehicles use gasoline and/or diesel fuel.

Diesel, gasoline and other relevant fuels, however, typically are not fully consumed or burned upon ignition of the fuel. As a result, some of the fuel, and often a significant percentage of the fuel is wasted and expelled as exhaust. This results in large amounts of emissions and lower fuel efficiency.

The accumulated effect of the large amounts of emissions from the millions of combustion engines accounts for a significant portion of today's air pollution. Further, because of the lower efficiency, the cost for operating these engines can be high and in some instances inhibitively high. Still further, the lower efficiency results in greater fuel consumption which can lead to a dependence on sources of fuel.

SUMMARY OF THE EMBODIMENT

The present invention advantageously addresses the needs above as well as other needs through the provision of the method, apparatus, and system for use in enhancing fuels. Some embodiments provide apparatuses for use in treating fuel that comprise a first conduit having an input end, an output end, and a metallic interior surface; a second conduit positioned within and axially aligned with the first conduit, the second conduit having input and output ends, and a plurality of apertures distributed along a length of the second conduit; and an impeller assembly comprising an impeller positioned between an adaptor sleeve and shaft support where at least the impeller and shaft support are fixed within the second conduit, and the adaptor sleeve is positioned at the input end of the second conduit.

Some embodiments provide apparatuses for use in enhancing fuel. These apparatuses include an exterior conduit, an input and an output cooperate with opposite sides of the exterior conduit through which fuel enters and exits respectively, a reaction cartridge assembly positioned within the exterior conduit to receive and at least induce cavitation of the fuel and outputting cavitated fuel, and biasing member positioned within the exterior conduit and cooperated with the reaction cartridge assembly to maintain a positioning of the reaction cartridge assembly.

Further embodiments provide methods for use in manufacturing a fuel treatment apparatus. Some of these methods are configured to assemble an impeller assembly, insert at least an impeller, a portion of an impeller shaft and an impeller shaft support of the impeller assembly into an inner conduit having a plurality of apertures distributed along a portion of a length of the inner conduit, slideably engage the assembled impeller assembly with the inner conduit, insert the inner conduit into an outer conduit having a diameter greater than a diameter of the inner conduit; engage at least a portion of the impeller assembly with the outer conduit, and secure the inner conduit with the outer conduit forming a reaction cartridge.

Some embodiments provide apparatuses for use in treating fuel. These apparatuses can include a first conduit having an input end, an output end, and a metallic interior surface; a second conduit positioned within and axially aligned with the first conduit, the second conduit having first and second ends, and a plurality of holes distributed along at least a portion of a length of the second conduit; and a treatment control bypass affixed with the second conduit configured to control an amount of fluid flow exiting the second conduit through the plurality of holes distributed along the portion of the length of the second conduit.

Other embodiments include methods for use in treating fuel. The methods are configured to deliver a fluid under pressure to a first conduit; forcing a first portion of the fluid out of the first conduit through a plurality apertures distributed along a length of the first conduit forming streams of fluid; cause the streams of fluid to impact an interior metallic wall of a second conduit that is axially aligned with and positioned about the first conduit treating the fluid to alter physical characteristics of the first portion of the fluid; and control the treating of the fluid including directing a second portion of the fluid out of the first conduit bypassing the plurality of distributed apertures.

Still Further embodiments further provide apparatuses for use in treating fuel. These apparatuses include a reactor cartridge assembly that further comprise an outer conduit having an input end, an output end, a metallic interior surface; and an inner conduit having a first end, a second end, a plurality of apertures distributed along a length of the inner conduit and a diameter that is less than a diameter of the outer conduit where the inner conduit is positioned within and axially aligned with the outer tube such that at least a portion of a fluid delivered to the inner conduit induces a first phase of cavitation upon dispersing the fluid through the plurality of holes to impact the metallic interior surface of the outer conduit. The apparatuses further include a biasing member positioned proximate the reactor cartridge assembly such that the biasing member maintains a positioning of the reactor cartridge assembly; and a first vortex positioned relative to reaction cartridge assembly causing a second phase of cavitation.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

The above and other aspects, features and advantages of the present invention will be more apparent from the following more particular description thereof, presented in conjunction with the following drawings wherein.

Figure 1:
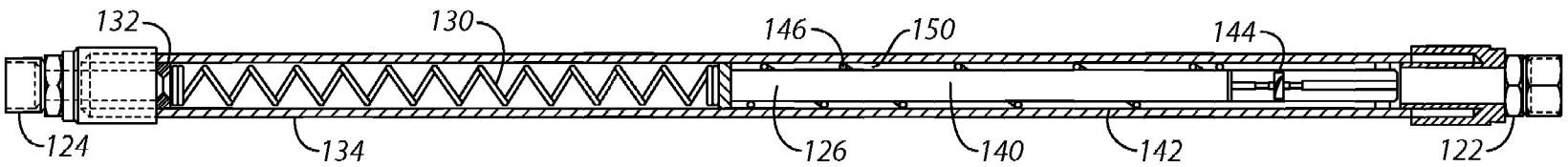
FIG. 1 depicts a simplified cross-sectional view of a fluid enhancement system according to some embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The present embodiments enhance the properties of fluids in part through multi-phase cavitation and altering the characteristics of the fluid. For example, the present embodiments can be applied to enhance and/or alter fuels, such as diesel, gasoline and other fuels that burn with reduced emissions and carbon deposits within an engine while also increasing engine power output and thus providing better engine efficient and reducing fuel consumption.

Untreated fuel burned through combustion engines typically fail to ignite portions of the fuel that are then expelled as exhaust. The failure to ignite portions of the fuel can result, in part from a failure to adequately vaporize the fuel due for example to the existence of long carbon chains. The present methods and apparatuses are utilized to enhance fuel, such as diesel and/or gasoline, to improve at least in part the combustible characteristics of the fuel.

FIG. 1 depicts a simplified cross-sectional view of a fluid enhancement system 120 according to some embodiments. The system 120 has an input coupling adaptor 122, an output coupling adaptor 124, a reaction cartridge assembly 126, a biasing or positioning member 130, one or more vortexes 132, and an exterior sheath conduit 134. The reaction cartridge assembly 126 includes an inner flutelike conduit 140, an outer conduit 142, an impeller assembly 144, and a spacer 146 that in part defines a gap or passage 150 established between the inner conduit 140 and outer conduit 142. The exterior sheath 134 is positioned between the input 122 and output 124, with the reaction cartridge assembly 126, biasing member 130 and vortex 132 sealed within the sheath 134. In operation, one or more fluids, such as a fuel, is supplied to the input 122 of the enhancement system 120 and is maintained within the exterior sheath 134 to flow through the reaction cartridge assembly 144, over the biasing member and through the vortex during treatment.

The present embodiments provide for a process and apparatus for use in the enhancement of fluids, such as diesel fuel, gasoline, and other fluids, wherein the fluids pass through the enhancement system 120 where multi-phase cavitation and exposure to a catalyst causes changes to the physical characteristics and properties of fluids, such as fuels to improve and enhance their effectiveness for combustion. In some implementations the enhancing systems 120 operate as an on-board fuel treatment center for engines and can be quickly and relatively easily incorporated with many types of combustion engines.

Cavitation is a process of bubble formation and collapse within a fluid. When the pressure in a flow field decreases below a vapor pressure of the fluid, some of the fluid vaporizes creating one or more bubbles. If the local pressure later increases above the vapor pressure, the bubble collapses. When the bubble collapse is rapid, the collapse takes place adiabatically and can produce relatively tremendous temperatures and pressures that can cause one or more chemical reactions to occur. Among the chemical reactions is a cracking of relatively long hydrocarbon chains into shorter chains and an increase in the vapor pressure that improves combustion. The present embodiments, at least in part, effectively employ multi-phase cavitation to treat fluids.

Still referring to FIG. 1, the system 120 creates changes in pressure and generates turbulence to establish an environment for multi-phase cavitation to occur. After and/or during cavitation the fuel is exposed to a catalyst material, such as copper, nickel, aluminum, copper alloy, and other relevant catalyst materials and/or combinations of materials, that relatively freely give off electrons that thereby impart an electrical/magnetic charge on the fluid being treated.

The creation of turbulence aids in the processing of the fluid. The turbulence can be introduced at least in part through the inclusion of the impeller assembly 144 as fully described below. The impeller operates effectively on the fluid pressure supplied by a fluid source, such as a fuel pump, and typically does not employ other sources of power.

The turbulence of the fluid is further enhanced by the configuration of the inner conduit 140. The fluid passes through a plurality of holes 226 (see FIG. 2) distributed over a portion of the length of the inner conduit and is exposed to an inner surface of the outer tube 142 that in some implementations includes a catalyst material as fully described below. Additionally, the spirally wound spacer 146 can be configured to further enhance the turbulence within the fluid.

Figure 2:
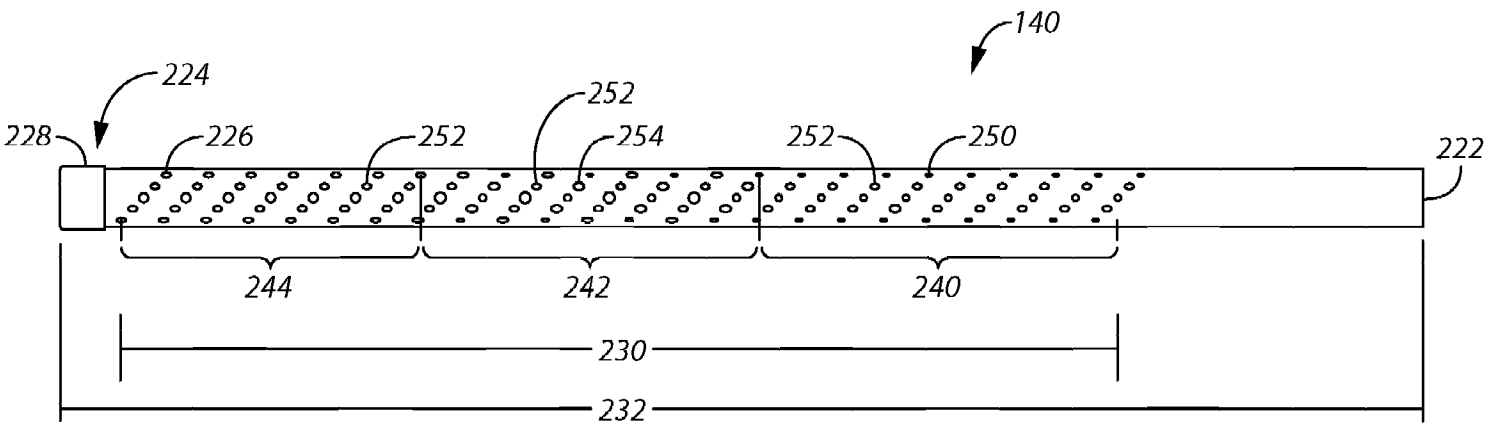
FIG. 2 shows a simplified plane view of the inner conduit of the system of FIG. 1.
Figure 3:
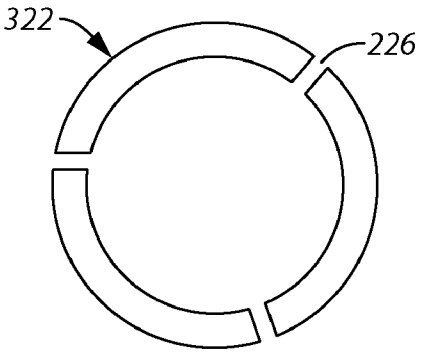
FIG. 3 depicts a simplified cross-sectional view of the conduit of FIG. 2 perpendicular to the length of the conduit.
Figure 7:
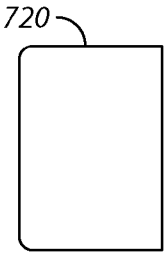
FIGS. 7-10 depict a plane view, end view, cross-sectional view, and isometric view, respectively, of an alternative embodiment of an end cap that can be incorporated into the system of FIG. 1.

FIG. 2 shows a simplified plane view of the inner conduit 140. FIG. 3 depicts a simplified cross-sectional view of the conduit 140 perpendicular to the length 232. Referring to FIGS. 2 and 3, the inner conduit has a first or input end 222, a second end 224, a plurality of holes or bores 226 distributed along at least a first portion 230 of the length 232 of the inner conduit 140, and an end cap 228 secured with the second end of the inner conduit. In some embodiments, a second portion 234 of the inner conduit does not include holes, and this portion 234 can house at least a portion of the impeller assembly 144 such that fluid received at the input 222 is directed through the impeller assembly before being expelled from the inner conduit. In some embodiments, the inner conduit acts as a diffuser for fuel enhanced through the system 120. The inner conduit 140 is shown as cylindrical with a circular cross-section, however, other configurations can be utilized. The inner conduit has a relatively rigid construction, but is not limited thereto. In some implementations, at least the exterior wall 322 of the inner conduit is coated with a catalyst and/or the inner conduit 140 can be formed of a catalyst, such as copper, copper alloy, nickel and other relevant catalysts and/or combinations of relevant catalysts.

The holes 226 are typically radial bores perpendicular to a longitudinal axis and axially spaced establishing communication between the interior and exterior of the inner conduit. In some embodiments the holes are round, however, the holes can have substantially any shape to achieve the desired effects as fluid is forced through the holes during operation. For example, the holes can be square, rectangular, triangular, star-shaped, elongated slots, other shapes and/or combinations of shapes. Similarly the holes can be configured with a single size, or multiple sized holes. For example a first portion 240 of the inner conduit can have holes of a first size 250 and a second size 252, a second portion 242 having holes of the second size 252 and a third size 254, and a third portion 244 with holes of just the second size 252. AS a further example, the first sized holes could have a diameter of about 0.093 inches, the second sized holes could have diameters of about 0.060 inches, and the third size holes could have diameters of about 0.078 inches, where the first, second and third portions 240, 242, 244 each have a length of about 3.6 inches and the inner conduit 140 has an inner diameter of about 0.50 to 0.60 inches. In some embodiments, the sum of the cross-sectional area of the holes is about equal to and generally less than the cross-sectional area of the interior bore or channel of the inner conduit perpendicular to the length 232.

The holes are further shown in a spiral pattern along the portion of the length 230 of the inner conduit. Other patterns can be utilized, such as diamond patters, rows, other patterns and/or combinations of patterns. For example, the holes 226 can be configured extending in a spiraling longitudinally axially spaced design or pattern. Again, the numbers and sizes of the holes can vary to achieve the desired cavitation and turbulence within the fluid being treated.

Figure 5:
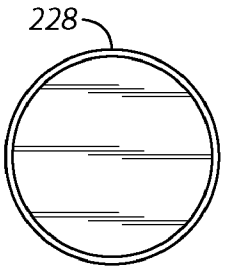
FIGS. 4-6 show a plane view, end view and cross-sectional view, respectively, of an end cap of the system of FIG. 1.
Figure 4:
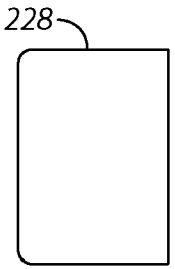
Figure 6:
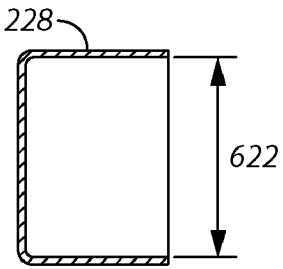
Figure 8:
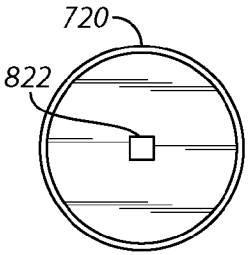

FIGS. 4-6 show a plane view, end view and cross-sectional view, respectively, of an end cap 228 according to some embodiments. The end cap has an inner diameter 622 that is about equal to or larger than an outer diameter of the inner conduit 140. The end cap 228 is secured with the second end 224 of the inner conduit 140 at least partially closing off the second end causing fluid supplied to the input 222 of the inner conduit to be agitated and forced through the plurality of holes 226 and radially away from the inner conduit. In some embodiments, the end cap completely seals the second end 224 of the inner conduit. In alternative embodiments, the end cap includes one or more bypass holes or apertures 822 (see FIG. 8) that allow a portion of the fluid supplied to the inner conduit to exit the inner conduit without having to pass through the plurality of apertures 226. The end cap can be secured with the inner conduit through screw threading, compression fit, welding, soldering, crimping, bolts, rivets, snaps, tongue and groove, and other relevant methods for securing the end cap with the inner conduit. Further according to some implementations, the end cap can be constructed of or coated with a catalyst material, such as copper, nickel, aluminum, and other relevant materials or combinations of materials.

Figure 11:
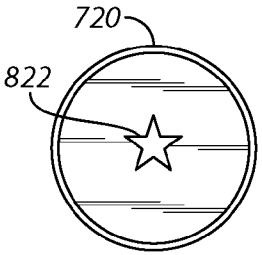
FIGS. 11-13 depict end views further alternate embodiments of the end cap of FIGS. 7-10.
Figure 12:
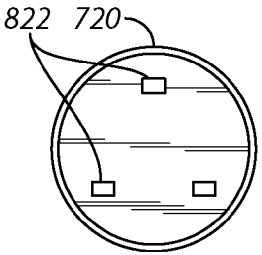
Figure 13:
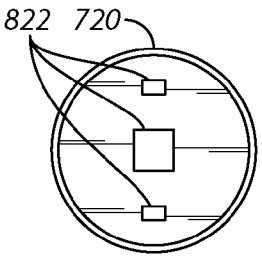

FIGS. 7-10 depict a plane view, end view, cross-sectional view, and isometric view, respectively, of an end cap 720 according to some alternative embodiments. FIGS. 11-13 depict end views of the end cap 720 with alternate configurations. Referring to FIGS. 7-13, the end cap 720 includes one or more bypass apertures 822 formed in and extending through the cap. The bypass aperture 822, at least in part, controls the reaction and/or enhancement of the fuel supplied to and flowing through the inner conduit 140. Further, the bypass aperture(s) can be square, circular, rectangular, triangular, star-shaped, or other relevant configurations and/or combinations of configurations to control the processing and/or reactions within the fuel.

The bypass aperture(s), at least in part, controls the flow of fluid and controls the treatment and/or reactions of the fluid. For example, the bypass aperture can allow some of the fluid to pass through the reaction cartridge assembly 129 generally un-reacted or untreated. By incorporating the bypass and allowing some fluid to pass through, less fluid is cavitated and imploded and/or the amount of cavitation is limited, and the level of treatment of the fluid is controlled. Additionally, the bypass aperture provides efficient acceleration of the fluid and as a result provides improved friction, implosion and cavitation of the treated fluid.

Controlling the amount of fluid that passes through the plurality of holes 226 along the inner conductor 140 further provides control over the reaction process of the fluid and thus controls the quality of the resulting treated fluid exiting the enhancement system 120. The bypass aperture 822 of the end cap 720 can, in some implementations, be configured to further control and/or reduce the pressure within the inner conduit, thus further controlling the velocity and/or pressure at which the fluid passes through the plurality of holes 226 along the inner conduit. Controlling the velocity at which the fluid exits through the plurality of holes of the inner conduit further controls the cavitation and/or the impact of the fluid with the catalytic inner surface of the outer conduit 142 providing greater control over the reaction of the fluid within the enhancement system.

The bypass aperture can be configured to allow some of the fluid to pass through the enhancement system generally untreated and/or unaltered to control a quality level of the fluid. Alternatively and/or additionally, the bypass aperture can be configured to establish some cavitation within the fluid as the fluid passes through the bypass aperture treating the fuel, but typically at a lesser extent than at least portions of 20 the fluid passing through the plurality of holes 226 along the inner conduit, to control the quality level of the treated fluid.

Figure 9:
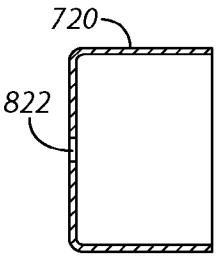
Figure 10:
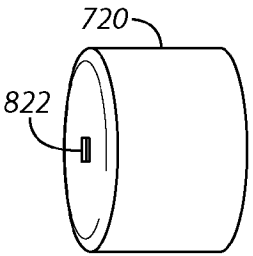

The bypass aperture 822 shown in the end view of the cap 720 in FIG. 9 has generally a square shape. It is noted, however, that other shapes and the numbers of apertures being employed can vary depending on the desired implementation, amount of cavitation if any through the bypass aperture and/or other similar conditions. For example, in some implementations, the bypass aperture can be round, oval, star shaped, rectangular, other shapes, consist of multiple holes (whether square, round, etc.), and/or combinations thereof. The size, shape and number of bypass apertures in the end cap depend on a desired fluid flow, pressure within the inner conduit, cavitation of fluid passing through the bypass aperture, cavitation of fluid passing through the plurality of holes 226 along the inner conduit and other factors. The diameter and/or area of the bypass aperture is dependent upon the implementations and/or the desired fluid flow control. Typically, the diameter and/or total cross-sectional area of the one or more bypass apertures is proportional to the diameter of the inner conduit. In some implementations, the diameter of a circular bypass aperture can range from 2 to 25 mm relative to an inner diameter of the end cap of about 0.6 inches for some applications.

Figure 15:
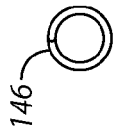
FIGS. 14 and 15 depict simplified isometric and end views, respectively, of a spacer that can be incorporated into the system of FIG. 1.
Figure 14:
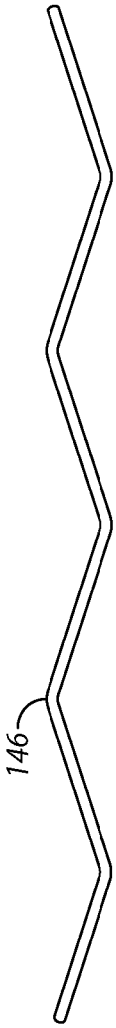

FIGS. 14 and 15 depict simplified isometric and end views, respectively, of the spacer 146. The spacer 146 is configured to be positioned about the exterior of the inner conduit 140, and in some embodiments is spirally wound around the inner conduit. The spacer, in part, maintains the positioning of the inner conduit 140 relative to the outer conduit 142. Additionally, the spacer in some implementations causes further agitation in the fluid as the fluid travels through the passage 150.

The spacer 146 can be secured with the exterior of the inner conduit 140 (or interior of the outer conduit 142) through soldering, welding, and other similar bonding techniques, pins or pegs and mating holes, compression fit, and other techniques. For example, in some implementations the spacer includes pins that extend radially inward toward the inner conduit and the inner conduit includes mating apertures that receive the pins to secure the spacer with the inner conduit. Typically, the spacer is positioned on the exterior of the inner conduit between the end cap and the impeller assembly and extends along the plurality of holes 226.

The spacer can be made of copper, a copper alloy, nickel, a nickel alloy, iron, iron coated with another metal (e.g., copper, copper alloy), aluminum and other relevant materials or combinations of materials. In some implementations, the spacer 146 is constructed of or coated with a catalyst material to aid in the reaction and enhancement of the fluid processed through the enhancement system 120. The spacer can have substantially any shaped cross-section, such as circular, rectangular, square, or other cross-sectional shapes. For example, the spacer can be formed from a wire or a rod shaped to the desired spiral configuration.

Figure 16:
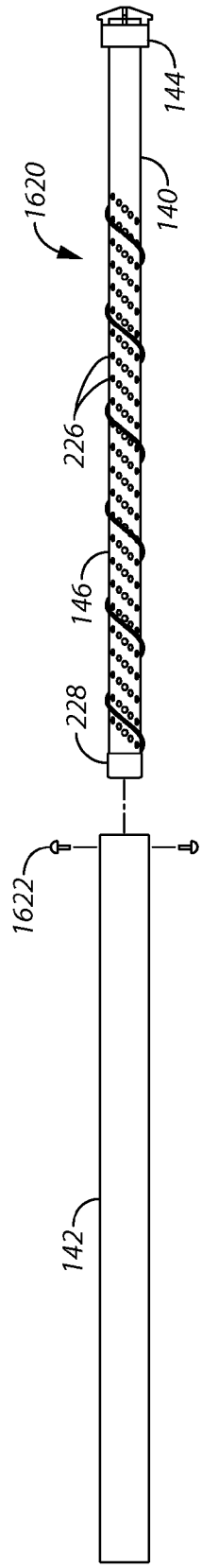
FIG. 16 shows an inner conduit assembly prior to being inserted into the outer conduit to form a reaction cartridge assembly of FIG. 1 according to some embodiments.

FIG. 16 shows an inner conduit assembly 1620 prior to being inserted into the outer conduit 142 to form a reaction cartridge assembly 126 according to some embodiments. The inner tube assembly consists of the inner conduit 140 with the plurality of holes 226, the spacer 146 spirally wound around the inner conduit, the impeller assembly 144 inserted into the inner conduit, and the end cap 228 secured with the inner conduit. The diameter of the inner conduit assembly 1620 is less than the inner diameter of the outer conduit such that the inner conduit assembly is inserted into the outer conduit. The inner conduit is secured with the outer conduit through screws 1622, pins, compression fit, crimping and/or other such methods.

Figure 17:
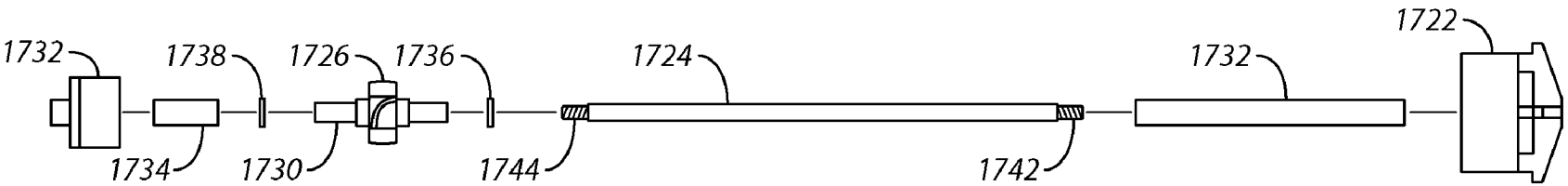
FIG. 17 depicts an exploded plane view of an impeller assembly that can be incorporated into the system of FIG. 1.
Figure 18:
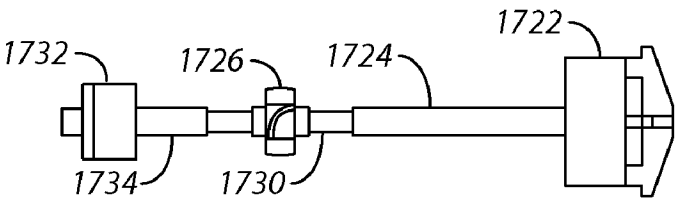
FIG. 18 depicts a plane view of the impeller assembly of FIG. 17 after assembly.

FIG. 17 depicts an exploded plane view of an impeller assembly 144 according to some embodiments. FIG. 18 depicts a plane view of an assembled impeller assembly 144. Referring to FIGS. 17 and 18, the impeller assembly 144 embodiments consists of an adaptor sleeve 1722, an impeller shaft 1724, an impeller 1726, an impeller sleeve 1730, and an impeller shaft support 1732. Some implementations of the impeller assembly further include one or more impeller spacers 1732, 1734, and washers 1736, 1738. In operation the impeller 1726 rotates due to the fluid pressure as fluid is supplied to the reaction cartridge assembly 126, and typically does not employ other sources of power. The rotation of the impeller agitates the fluid, creates turbulence and/or induces cavitation. The agitation, turbulence and/or cavitation aid in the processing of the fluid.

The adaptor sleeve 1722 receives a first end 1742 of the impeller shaft 1724 and supports the shaft at the first end. Similarly, the impeller shaft support 1732 receives a second end 1744 of the impeller shaft and supports the impeller shaft. The first and second ends of the impeller shaft 1724 can be secured with the adaptor sleeve 1722 and shaft support 1732, respectively, by screw threading, pins, deforming the ends, soldering, welding and/or other methods or combinations of methods. A thread lock material can additionally be used when screw threading is employed. In some embodiments, the impeller shaft is a rod formed from stainless steel or other relevant material.

The impeller 1726 is positioned about the impeller sleeve 1730 such that the sleeve extends through a central bore 2422 (see FIG. 24) with the impeller free to spin about the sleeve. The impeller sleeve 1730 can be constructed of and/or coated with a material that reduces friction and/or withstands expected levels of heat caused by friction as the impeller rotates about the sleeve, such as Teflon® (e.g., a clear Teflon (PTFE)), or other relevant materials. Further, the impeller sleeve is a hollow, elongated rod or sleeve that fits over the impeller shaft 1724.

The impeller 1726 and/or impeller sleeve 1730 are positioned on the impeller shaft such that the impeller rotates within the inner conduit 140 (see FIG. 1). The positioning of the impeller and/or impeller sleeve on the shaft can be achieved through one or more methods, such as impeller spacers 1732, 1734, solder, welding, friction fit, crimping, and/or other methods or combinations of methods. Some embodiments utilize an impeller spacer on each side of the impeller and/or impeller sleeve to position the impeller at a predefined location between the adaptor sleeve 1722 and impeller shaft support 1732.

In the embodiment depicted in FIGS. 17 and 18, a first impeller spacer 1732 is a hollow, elongated rod or sleeve that fits over the impeller shaft 1724 and is positioned to abut against the adaptor sleeve 1722 at a first end and the impeller sleeve 1730 at the other end; and the second impeller spacer is similarly a hollow, elongated rod or sleeve that fits over the impeller shaft 1724 and is positioned to abut against the impeller shaft support 1732 at a first end and the impeller sleeve 1730 at the other end. The spacers can be constructed of a metal, metal alloy, or other relevant material, such as a 316 stainless steel hollow tube. Some embodiments further employ washers 1736, 1738 between the impeller spacers 1732, 1734 and the impeller sleeve 1730 to in part further maintain positioning and improve ware. The washers can be formed from substantially any relevant material, such as nylon, plastic, polyurethane, or other relevant material, and have dimensions that correspond to the dimensions of the spacers 1732, 1734 and/or impeller sleeve 1730.

Figure 21:
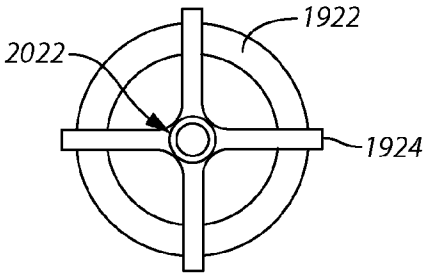
FIGS. 19-21 depict a side plane view, a cross-sectional view and an end plane view, respectively, of an adaptor sleeve of the impeller assembly of FIG. 17.
Figure 20:
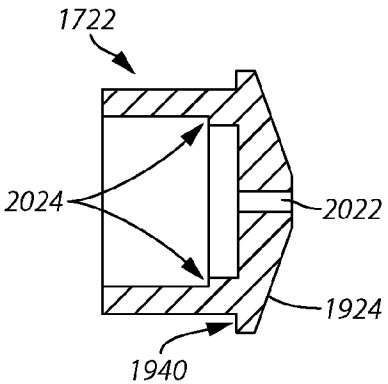
Figure 19:
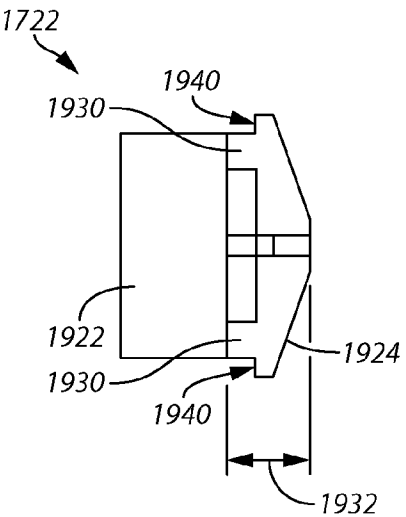

FIGS. 19-21 depict a side plane view, a cross-sectional view and an end plane view, respectively, of the adaptor sleeve 1722 as implemented according to some embodiments. The adaptor sleeve is hollow, and includes a body 1922, supports 1924, and an impeller shaft receiving aperture 2022. In some embodiments, the body is generally cylindrical in shape such that the adaptor sleeve is configured to slide over the exterior of input end 222 of the inner conduit 140, and includes a shelf or lip 2024 formed on an interior of the body 1922 that abuts against the input end 222 when cooperated with the inner conduit. Fluid supplied to the enhancement system 120 flows through the adaptor sleeve and into the inner conduit.

The adaptor sleeve 1722 can be secured with the inner conduit through one or more of several methods including, but not limited to, friction fit, screw threading, pins, crimping, soldering, welding and/or other methods or combinations of methods. For example with some implementations, the inner diameter of the hollow body 1922 of the adaptor sleeve 1722 is about equal to or just greater than the outer diameter of the inner conduit 140 providing a secure friction fit when the adaptor sleeve 1722 is cooperated with the inner conduit. Further, the adaptor sleeve can be formed of metal, metal alloy, and other relevant materials. For example, some embodiments of the adaptor sleeve are formed of a copper alloy 145 per ASTM (American Society for Testing and Materials) B301 half hard.

The supports 1924 of the adaptor sleeve can be contiguous with the body 1922 or formed as separate pieces that are secured (e.g., with soldering, welding or the like) with the body. The supports include legs 1930 that extend from the body 1922. Typically, the adaptor sleeve includes two or more supports 1924, for example, some embodiments include four supports positioned at right angles to neighboring supports defining gaps between each support through which fluid can pass. The impeller shaft receiving aperture 2022 is axially aligned with a central axis of the adaptor sleeve and supported by the supports 1924 such that the supports extend from the impeller shaft receiving aperture 2022 to at least the legs 1930. The impeller shaft receiving aperture receives the first end 1742 of the impeller shaft and can be threaded to mate with the impeller shaft 1724 or utilize other methods to cooperate and/or secure the impeller shaft with the adaptor sleeve.

In some implementations, the supports 1924 taper in thickness 1932 with the thickest portion being adjacent the impeller shaft receiving aperture 2022 and tapering to a smaller thickness at the legs. The supports 1924 can, in some embodiments, further extent beyond the legs 1930 and the outer perimeter of the body 1922 forming ledges 1940. These ledges 1940 cooperate with the outer conduit 142 to position the impeller assembly and/or reaction cartridge assembly 126 relative to the outer conduit as fully described below.

Figure 23:
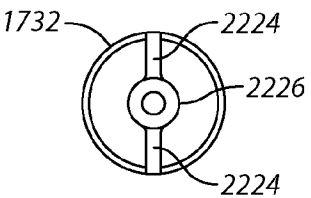
FIGS. 22-23 depict side plane and end plane views, respectively, of a shaft support of FIG. 17.
Figure 22:
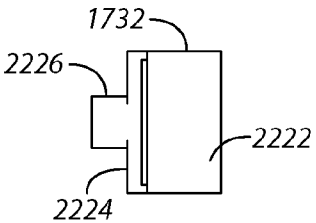

FIGS. 22-23 depict side plane and end plane views, respectively, of the shaft support 1732. The shaft support comprises a hollow body 2222, supports 2224 and a shaft receiving aperture 2226. Typically, the shaft support body has a shape and dimensions that conform to the shape and dimensions of the inner conduit 140. For example, the shaft support body can be cylindrical with a diameter that is about equal to or less than the diameter of the interior of the inner conduit 140 such that the shaft support can be inserted into the inner conduit. Because the shaft support is hollow, the fluid supplied to the fluid enhancement system 120 flows through the hollow support shaft.

Similar to the adaptor sleeve 1722, the shaft support 1732 includes a plurality of supports 2224, for example two supports aligned on opposite sides of the shaft receiving aperture 2226. The supports extend from the body 2224 to the receiving aperture supporting the receiving aperture. In some embodiments, the shaft support is milled and/or molded of a single contiguous piece. The shaft support, however, can be formed of separate pieces secured together, for example through soldering, welding or other relevant methods. The shaft receiving aperture 2226 receives the second end 1744 of the impeller shaft and can be threaded to mate with the impeller shaft 1724 or use other methods to cooperate and/or secure the impeller shaft with the receiving aperture 2226. Further, the shaft support 1732 can be formed of metal, metal allow and other relevant materials, such as copper alloy similar to the adaptor sleeve.

Figure 25:
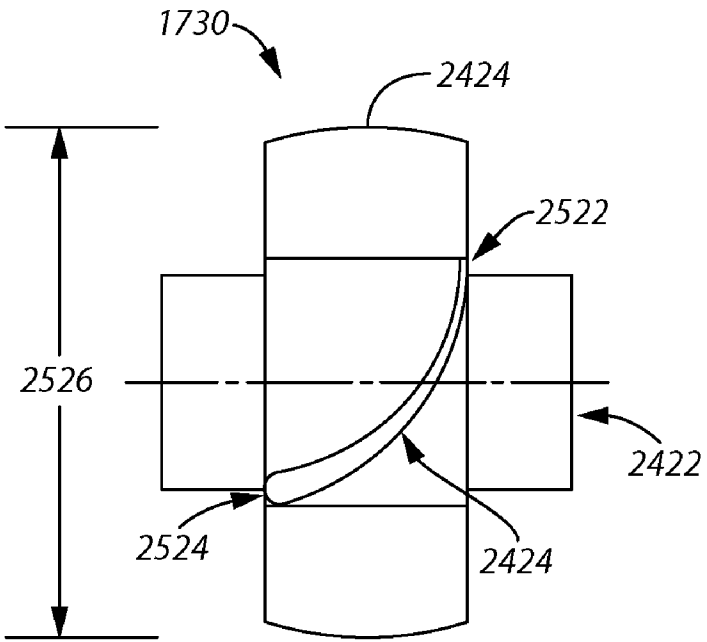
FIGS. 24 and 25 depict end and side plane views, respective, of an impeller of FIG. 17.
Figure 24:
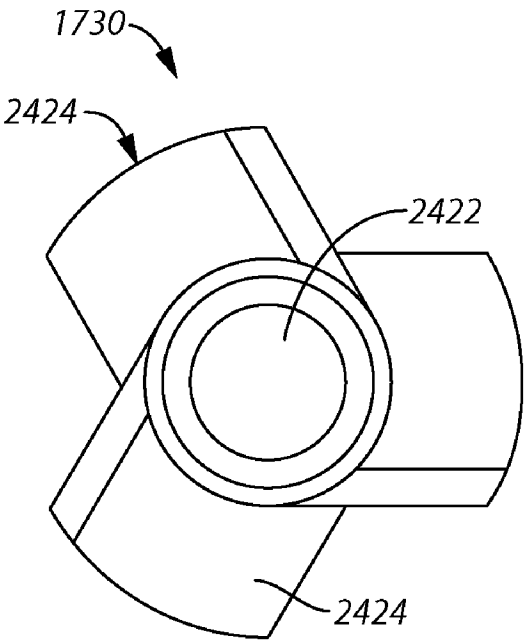

FIGS. 24 and 25 depict end and side plane views, respective, of an impeller 1726 according to some embodiments. The impeller includes a central bore 2422 and a plurality of blades 2424. The central bore has a diameter that is about equal to or greater than a diameter of the impeller sleeve 1730 such that the impeller sleeve extends through the central bore when assembled. Further, the central bore can extend beyond the blades adding stability and/or limiting wobble of the impeller during spinning.

The impeller can include substantially any number of blades 2424. The blades are configured such that at least the impeller rotates about the shaft 1724 as the fluid is passed through the inner conduit 140 and around the blades agitating the fluid, causing turbulence and/or cavitation within the fluid. In some implementations, the blades extend from about a first side 2522 of the impeller 1726 along an arc to about a second side 2524. Further, the blades can increase in thickness along the arc such that the portion of the blade proximate the second side 2524 is thicker than the portion of the blade proximate the first side. The pitch of the blades can vary depending on the desired effects on the fluid and the desired rotational speed based on expected fluid flow patterns and/or velocities, the number of blades and other relevant factors. For example, some embodiments may have a pitch of about 40 to 50 degrees, while other embodiments might have a pitch between 20 and 70 degrees. The diameter 2526 of the impeller is less than an interior diameter of the inner conduit 140 such that the impeller can be inserted into the inner conduit and can rotate within the inner conduit without contacting the interior wall of the inner conduit. The impeller 1726 can be tooled, formed and/or molded from metal, metal allow, and other relevant materials or combinations of materials. For example, the impeller in some embodiments is formed of stainless steel, such as 303 stainless steel.

Figure 26:
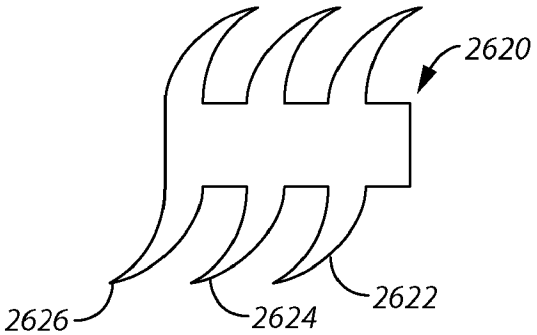
FIG. 26 depicts a simplified cross-sectional view of an impeller according to an alternate configuration.

FIG. 26 depicts a simplified cross-sectional view of an impeller 2620 according to an alternate configuration. The impeller 2620 includes three sets 2622, 2624, 2626 of impellers. The impeller imparts motion to the fluids passing within the inner conduit, and form part of a helical surface creating cavitation. Again, the blades can be configured with a desired angle of deflection, such as a forty-eight degree angle of deflection. Additionally and/or alternatively in some embodiment, the blades can include pointed tip. The blades induce cavitation, and in some implementations further enhance cavitation by creating a string pool action within the fluid flow. The cooperation of the three sets of impellers further induces agitation and turbulence in the fluid according to some implementations. Other impeller configurations can be employed to achieve desired agitation and/or cavitation within the interior of the inner conduit 140.

Referring back to FIG. 16, the inner conduit assembly 1620 is shown assembled and prior to being inserted into the outer conduit 142. The outer conduit has an interior diameter that is at least equal to and typically greater than the diameter of the end cap 228 and/or spacer 146. As such, the gap or passage 150 is formed between the exterior of the inner conduit 140 and the interior of the outer conduit 142. Further, the interior diameter of the outer conduit is equal to or just greater that the outer diameter of the body 1922 of the adaptor sleeve 1722 of the impeller assembly 144. Upon assembly of the reaction cartridge assembly 126, the body 1922 of the adaptor sleeve 1722 is in contact with the interior wall of the outer conduit and forms a seal with the outer conduit such that as fluid is supplied to the enhancement system 120, fluid is directed into the inner conduit 140 through the adaptor sleeve and does not directly enter the outer conduit 142 but instead is directed from the inner conduit into the passage 150 between the inner conduit and the outer conduit through the plurality of holes 226. Some embodiments additionally and/or alternatively incorporate an additional seal between the adaptor sleeve and the interior wall of the outer conduit, such as an O-ring, gasket, or other seal.

Figure 27:
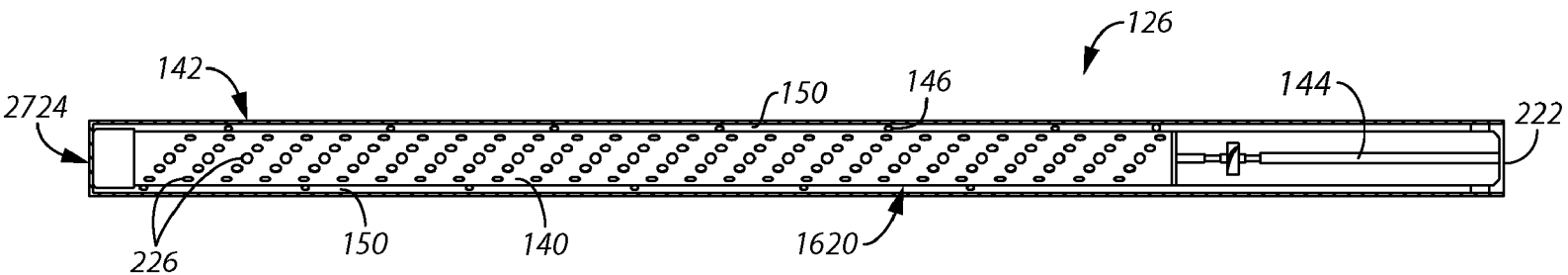
FIG. 27 depicts a simplified cross-sectional view of a reaction cartridge assembly that can be implemented in the system of FIG. 1.

FIG. 27 depicts a simplified cross-sectional view of a reaction cartridge assembly 126 as implemented according to some embodiments. The inner conduit assembly 1620 is shown axially aligned within the outer conduit 142 with the gap or passage 150 defined between at least the exterior wall of the inner conduit 140 and the interior wall of the outer conduit 142. In operation, fluid is supplied to the input 222 of the inner conduit where the fluid passes through and around the impeller assembly 144, at least a portion of the fluid flows out the plurality of distributed holes 226 and into the passage 150 where the fluid flows to an output 2724 of the outer conduit 142 and reaction cartridge assembly 126.

Typically, the pressure within the inner conduit is at levels such that the fluid exits the plurality of apertures as streams of fluid that are directed against and/or impact the interior wall of the outer conduit 142. The rapid change in pressure as the fluid passes through the plurality of holes 226 and into the passage 150 causes cavitation within the fluid that at least induces cracking of some long carbon chain molecules. The fluid continues to contact the interior wall of the outer conduit, the exterior wall of the inner conduit 140 and the spacer 146 as the fluid travels along the passage 150. As such, some embodiments coat the interior wall of the outer conduit, the exterior wall of the inner conduit 140 and/or the spacer 146 with a catalyst material, and/or construct the outer conduit, the inner conduit 140 and/or the spacer 146 from a catalyst material. For example, the interior wall of the outer conduit 142 can be coated with a copper alloy (e.g., copper-aluminum alloy), and the inner conduit 140 and spacer 146 can be constructed from a copper alloy. Coating and/or constructing the interior wall of the outer conduit, the exterior wall of the inner conduit 140 and the spacer 146 with a catalyst material increases the exposure of the fluid to the catalyst to further aids in the process of enhancing the fluid. In some embodiments, the catalyst material releases electrons to the fluids further altering the physical characteristics of the fuels and/or in part aiding the cracking carbon chain molecules.

Referring back to FIG. 1, the reaction cartridge assembly 126 is further contained within the exterior sheath conduit 134 that provides protection for the reaction cartridge assembly and other internal components of the enhancement system 120. The exterior sheath conduit typically has a diameter that is equal to or greater than the outer diameter of the outer conduit 142, and in some embodiments is in contact with the exterior surface of the outer conduit when the fluid enhancement system 120 is assembled and/or in use. Further, the exterior sheath conduit 134 is configured to withstand predefined pressures and can be constructed of substantially any relevant material capable of carrying the fluid intended to be treated (e.g., fuel). In many instances, the exterior sheath conduit is a multi-layer hose, such as a hydraulic hose that includes one or more layers of synthetic rubber tubing, one or more braids of high wire reinforcement (e.g., tensile steel wire reinforcement), one or more metallic conduits, and/or other layers. For example, in some embodiments the exterior sheath conduit is a hydraulic hose SAE100R1AT no SKIVE rated for 1000 psi, from Parker Hannifin Corporation of Cleveland, Ohio.

The fluid enhancement system 120 can further include in some embodiments the biasing member 130, vortex 132, and input and output coupling adaptors 122, 124. The biasing member 130 in some embodiments is a spirally wound rod or spring that is positioned between the output coupling adaptor 124 and the reaction cartridge assembly 126. In some implementations, the biasing member is compressed upon insertion establishing a force against the reaction cartridge assembly to maintain positioning of the reaction cartridge assembly relative to at least the input coupling adaptor 122. The biasing member can be constructed of substantially any relevant material and in some implementations is further constructed of and/or coated with a catalyst material. For example, the biasing member can be a spring constructed of 0.125 inch copper rod alloy C11000 ASTM B187 wound in a spiral to a desired length and compressibility. The diameter of the biasing member is less than the diameter of the interior of the exterior sheath conduit. Additionally, the biasing member in some implementations causes further agitation and/or additional cavitation in the fluid as it is pushed through, over and/or around the bias member.

Some embodiments further include a vortex 132 positioned proximate the output coupling adaptor 124, and in some instances is further pressed against the output coupling adaptor by the biasing member 130. The vortex can act as a reducer maintaining a desired pressure within the enhancement system 120 and/or increase turbulence within the flowing fluid.

Figure 29:
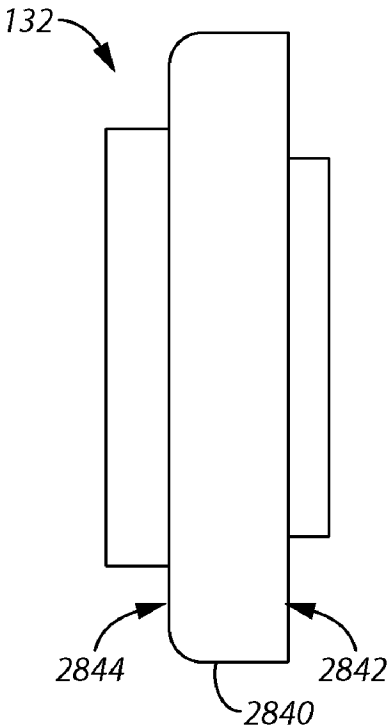
FIGS. 28 and 29 depict a side plane view and a cross-sectional view, respectively, of a vortex of the system of FIG. 1.
Figure 28:
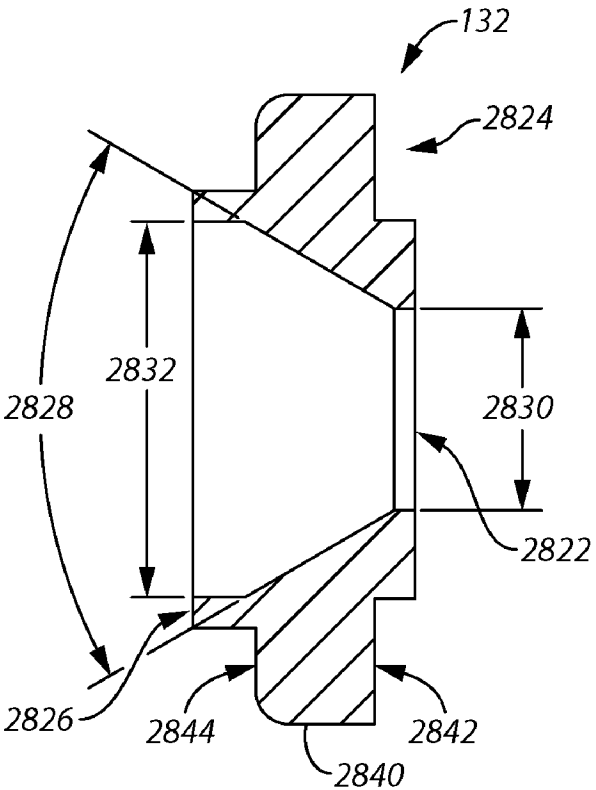

FIGS. 28 and 29 depict a side plane view and a cross-sectional view, respectively, of a vortex 132 according to some embodiments. The vortex includes a central bore 2822 that extends from a first side 2824 through the vortex to a second side 2826 such that fluid can pass through the vortex. The central bore has a first diameter 2830 at the first side and tapers to a wider diameter 2832 at the second side 2826. The angel 2828 by which the bore tapers depends on the fluid flow, the pressure and other parameters. In some embodiments, the angel 2828 at which the tapering occurs is approximately 60 degrees, however, other configurations can have different angles depending on desired effects. An annular extension or ring 2840 extends around the vortex defining a first ledge or shelf 2842 relative to the first side 2824 that is configured to cooperate with and/or abut against the biasing member 130, and a second ledge or shelf 2844 relative to the second side 2826 that is configured to cooperate with and/or abut against the output coupling adaptor 124.

The central bore 2822 can have substantially any relevant cross-sectional shape, such as but not limited to, circular, square, rectangular, oval, triangular, star shaped and/or other configurations. Additionally, the central bore can be replaced with a plurality of bores of relevant shape and/or other configurations to achieve a desired flow control and/or fluid treatment. An increase in turbulence, agitation and/or cavitation results in the fluid as the fluid passing through the central bore causing further reactions within the fluid. The vortex 132 can be constructed of metal, metal alloy, and other relevant materials, and in some embodiments is formed of and/or coated with a catalyst material such as copper, copper alloy, aluminum and other such materials or combinations of materials. For example, in some implementations, the vortex is formed of a copper alloy 145 per ASTM B301 half hard.

The fluid enhancement system 120 can further include a vortex near or at the input of the system and/or reaction cartridge assembly 126 to initiate additional agitation within the fluid. In some embodiments, the adaptor sleeve 1722 of FIG. 17 can additionally include a vortex. For example, the interior of the hollow body 1922 can include a tapered bore similar to that shown in FIG. 28. As such, the system can include an upstream vortex for increased agitation, friction and/or cavitation. Other embodiments include a separate upstream vortex, for example a vortex similar to the vortex 132, positioned prior to the reaction cartridge assembly 126. As such, the vortex can provide a phase of cavitation prior to the cavitation induced through the reaction cartridge assembly (e.g., phase of cavitation induced by the impeller, phase of cavitation induced by the diffusing of the fluid through the holes 226, and/or the phase of cavitation induced by the spacer and/or interior of the outer conduit).

Figure 30:
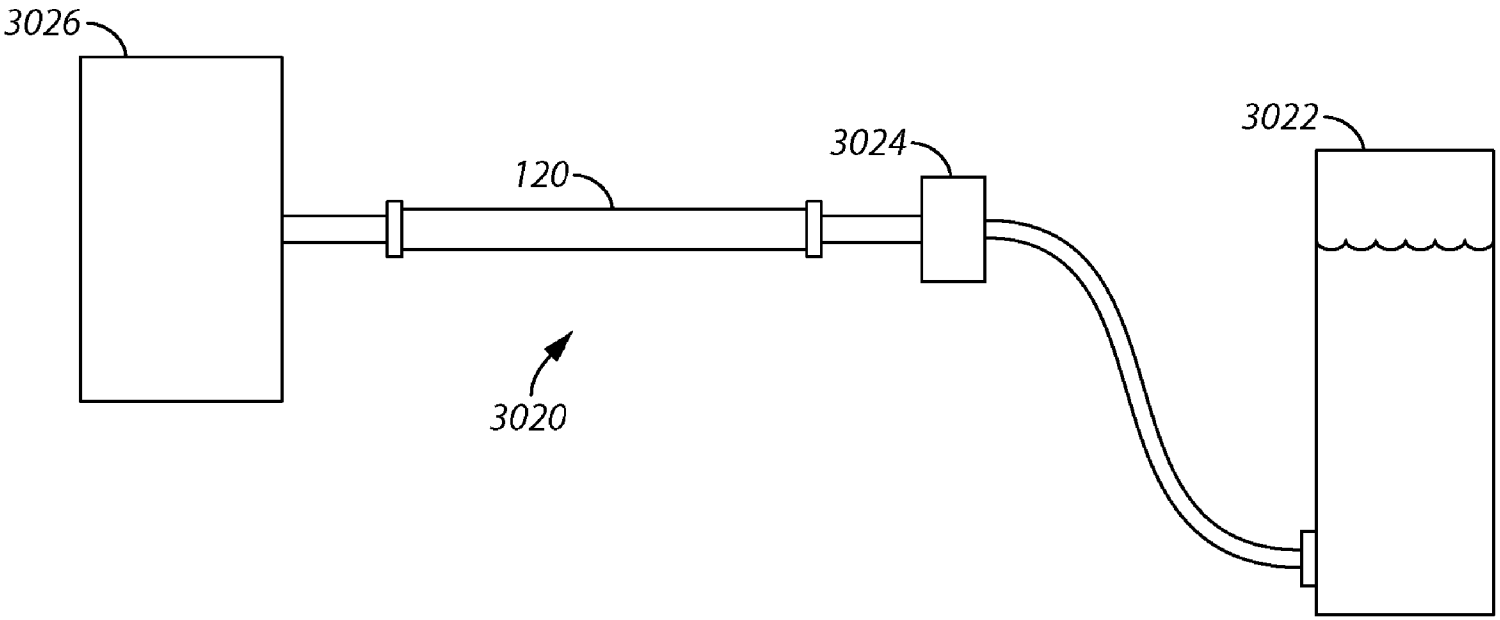
FIG. 30 depicts a simplified block diagram of a system that uses fluids that are treated or enhanced through a fluid enhancement system.

FIG. 30 depicts a simplified block diagram of a system 3020 that uses fluids that are treated or enhanced through a fluid enhancement system 120. The system includes a reservoir or tank 3022, a pump or other fluid delivery device 3024, the fluid enhancement system 120, and a fluid consumption device 3026. For example, the consumption device can be a combustion engine and the reservoir can contain fuel (e.g., diesel or gasoline) that is pumped through the enhancement system 120 prior to being delivered to the engine (e.g., delivered to a carburetor for atomization into a piston cylinder).

The fluid enhancement system, at least in part, allows for the controlled restructuring of fluids, such as fuels to a more beneficial molecular state for more optimal use and resulting performance from their use. The hydrodynamic configurations of the fluid enhancement system 120 cause vaporation and/or cavitation on approximately a microscopic scale. The vaporation and/or cavitation along with catalyst contact cause one or more of the following effects to occur with the fluid and/or fuel: the cracking of relatively long hydrocarbon chains into shorter chains; magnetic fields are induced into the fuel; and/or entrained water and impurities are released.

In operation, at least the reaction cartridge assembly 126 (see FIG. 1) initiates the formation of macroscopic bubbles in the fluid that implode into small, sub-microscopic, nano-clusters (where nano-clusters are clusters of molecules typically ranging about from 1-100 nanometers in size). These implosions create high temperatures and high-pressures on a nano-scale. In some implementations, a magnetic field within the fluid is also formed through magneto hydrodynamics (MHD). An electromotive series can be established in some reaction cartridge assembly 126 where surrounding electromotive series negatively charges the fluid in the presence of a material catalyst. Further, the present embodiments can provide control over the flow of the fluid through the system that aids in controlling the treatment of the fluid and controlling the treatment of the fuel within the system.

The fluid enhancement system 120 in some implementations is an on-board fuel treatment center, increasing the overall quality of the fluids, such as diesel and gasoline fuels, and/or other fluids. The cracking of hydrocarbon chains into shorter hydrocarbon chains creates a more easily combustible fuel. The reaction cartridge assembly can also allow entrained water and impurities from the fuel to be freed and captured by fuel filters external to the enhancement system 120. This higher quality fuel results in improved fuel economy, lower emissions, and more power throughout the operating range of the engine.

Still referring to FIG. 30, as the fuel is pumped from the reservoir the fuel is forced into the inner conduit 140 (see FIG. 1) and streamed through the plurality of apertures such that cavitation within the fuel results causing cracking of relatively long carbon chain molecules. Further, the fuel contacts the catalytic interior wall of the outer conduit 142, exterior wall of the inner conduit, the spacer 146 and/or biasing member 130, where electrons are released from the catalyst material further altering the physical characteristics of the fuels, such as ionization, i.e., electrical charging, of a significant number of the molecules of the treated liquid or gas. The enhanced fuel is then supplied to the engine 3026 where the engine ignites the fuel with more complete combustion of the fuel supplied to the piston chamber, and further resulting in reduced emissions.

The fluid enhancement system is configured to be retrofitted into an exiting fuel line or other existing fluid consumption systems. Further, the fluid enhancement system can be incorporated directly into new engine designs, such as cooperated with the pump and/or fuel filter, or incorporated with a carburetor. The improved combustion of treated fuel further provides greater thrust, and reduced fuel consumption.

The inventors of the subject fluid enhancement system further identified that with some combustion engine systems, such as long haul diesel engines, the fuel processed through the fluid enhancement system can potentially be over treated causing excessive breakdown of the fuel and thus reducing the beneficial effects of the enhanced fuel. This adverse affect can occur in some diesel systems that recycle a portion of the fuel extracted from the tank. For example, diesel fuel is extracted from the tank passes through the enhancement system treating the fuel. With some diesel combustion systems, a portion of that fuel that was enhanced is recycled back to the tank to be later retrieved and again processed through the enhancement system. Because of the continued recycling of the fuel, portions of the fuel can be over treated and/or excessively cracked reducing the combustibility of the portion of the fuel.

Some embodiments address this over treating by controlling the treatment of fuel. These embodiments control the treatment of the fuel by bypassing a portion of the fuel out of the inner conduit such that the portion bypassed is not treated or is treated at reduced levels. As the fuel is recycled, less of the fuel is treated or fully treated so that upon re-treating less of the fuel of over treating. Therefore, the bypass allows the system to control the level treatment and thus reduce the over treating of fuel and improved fuel efficiency and combustion.

The bypass control is implemented in some embodiments through one or more bypass aperture 822 (see FIG. 8) in the end cap. By incorporating the bypass and allowing some fluid to pass through, less fluid is cavitated and imploded or cavitated at a lesser extent and the level of treatment of the fluid is controlled. The one or more bypass apertures in the end cap, in some implementations, reduce the likelihood and/or effects of clogging and/or restriction of the flow, and other problems or errors. Further in the treatment of fuel, the bypass aperture allows additional control over the treatment of fuel, such as diesel or gasoline to reduce engine ware of an engine using the treated fuel due to a lean mixture. Still further, the bypass aperture allows, in some embodiments, for a quicker and more immediate response to throttle increases, improved fuel economy, increased power and improved durability.

Figure 31:
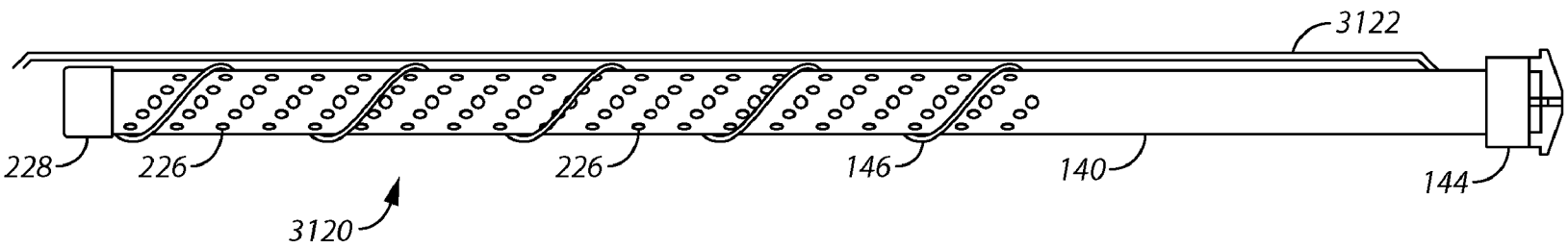
FIG. 31 depicts an alternative embodiment of a reaction cartridge assembly for use in a fluid enhancement system.

FIG. 31 depicts an alternative embodiment of a reaction cartridge assembly 3120 for use in a fluid enhancement system. The reaction cartridge assembly 3120 further includes a bypass tube or passage 3122 cooperated with in addition to the inner conduit 140, the spacer 146, end cap 228 and the impeller assembly 144. The bypass tube 3122 is configured with a defined diameter and positioned along, for example, the exterior of the inner conduit to allow a defined percentage of fluid to bypass at least the plurality of holes 226 and/or the impeller (not shown in FIG. 31) to limit and/or prevent treatment of that percentage of fluid. In some implementations, the bypass tube opening is after the impeller to allow some cavitation within the fluid prior to bypassing the flute inner tube. The bypass tube can be formed of a catalytic material as described above and/or coated with a catalytic material. Still further in some embodiments, the bypass tube is used in cooperation with the end cap that includes one or more bypass apertures to control the treatment of the fluid.

Other method can be employed to provide additional and/or alternative control of the treatment of the fluid. For example, the adaptor sleeve 1722 of the impeller assembly can be configured to allow a portion of the fluid supplied to the reaction cartridge assembly 126 to pass around the exterior of the inner conduit 140 where that portion of the fluid is not agitated by the impeller and not forced through the plurality of holes 226 thus allowing control over the treatment of the fluid.

Figure 32:
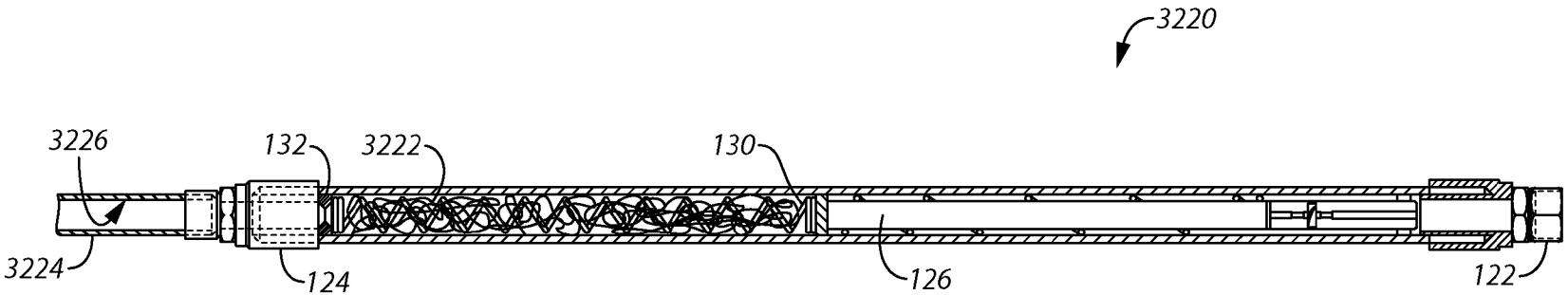
FIG. 32 depicts a cross-sectional view of a fluid enhancement system according to some embodiments.

Still further, some embodiments incorporate additional catalytic material into the fluid enhancement system 120 and/or following the system. FIG. 32 depicts a cross-sectional view of a fluid enhancement system 3220 according to some embodiments. The system includes a reaction cartridge assembly 126, biasing member 130, vortex 132, input and output coupling adaptors 122, 124, and further includes a fibrous webbing, array or matting 3222 of catalytic material, such as copper, aluminum, copper-aluminum alloy, other alloys and/or other relevant materials. The fibrous matting 3222 exposes a large amount of surface area of one or more catalyst materials to fluid passing through and/or around the matting. By increasing the interaction of the fluid with the catalyst, some embodiments further enhance the reactions within the fluid and improve the treatment of the fluid. Some embodiments further increase the number of windings of the biasing member 130 and/or implement alternate configurations to further increase surface area that is exposed to fluid traveling through the system.

The system 3220 further increases the amount of catalyst that interacts with the fluid by incorporating a delivery tube 3224 between the fluid enhancement system 3220 and fluid destination (e.g., an engine). The delivery tube 3224 includes an interior lining or coating 3226 constructed from one or more catalyst materials, such as copper, aluminum, or copper alloy and/or other materials. The fluid exiting the enhancement system 3220 are further treated through the exposure to additional catalyst in the delivery tube 3224.

As such, the fluid enhancement systems of the present embodiments enhance the properties of fuel and other fluids through multi-phase cavitation. Further, the enhanced and/or altered fuel can be burned with reduced emissions and carbon deposits within an engine while also increasing engine power output and thus providing better engine efficient and reducing fuel consumption.

For example, combustion reactions within a diesel engine is the result of the combustion of a hydrocarbon, oxygen and an initial input of energy yielding water, carbon dioxide and a positive net heat reaction value. The heat value is converted to power in an engine through the pressure of the thermal expiation against a piston. Typically, in order for the hydrocarbon and oxygen to combine, the hydrocarbon should exist in a vapor state. The heat of the reaction in the combustion chamber is often high enough to vaporize the majority of incoming fuel. As the quality of the fuel degrades (e.g., longer carbon chain structures) the amount of the hydrocarbon converted to vapor diminishes, resulting in unburned hydrocarbons produced as emissions.

Treating fuel through the fluid enhancement system of the present embodiments provide in part for greater vaporization and thus greater combustion, increased power output and reduced emissions. For example, the present embodiments enhance diesel fuel by changing the properties of the fuel to a higher more reactive fuel through a change in vapor pressure from decane to heptane. This affects the activated combustion and increases the energy within the fuel. Further, this raises the Reid Vapor Pressure and greatly affects the activated combustion resulting in an increase of energy from the reaction and allows a more efficient combustion.

Further, some implementations of the present embodiments eliminate certain naturally found problematic substances of many fuels. Increases in a refinery hydro treating process can actually decrease a fuels lubricity, due to hydro treating reducing the sulfur content of the fuel, in some instances, to about 0.5%. Additionally, one favorable characteristic of diesel fuel is a natural ability to shed water and prevent fuel/water emulsion. Hydro-treating diesel has shown a negative tendency to absorb and hold relatively large quantities of water. The presence of water can promote microbial activity, fuel/water emulsions, rust, corrosion and other adverse effects.

Hydro treating fuels can also form peroxide levels high enough to be incompatible with fuel system components. Peroxide formation is several hydro treated aviation fuels has caused problems of the fuel system elastomer, hardening and cracking from exposure to high peroxide levels. Recent studies have found that a large number of low sulfur diesel fuels have the tendency to form relatively high levels of peroxide when treated with Antioxidants.

Surfacants are substances that reduce the surface tension of fuel/water emulsion. The surface-active compounds come from various sources including refinery treatment, chemicals, naturally occurring materials not removed from crude, substances incorporated from other products in the distribution system additives and lube oil blended into fuel.

The fluid enhancement system of the present embodiments can be configured in substantially any size for many different applications, such as being incorporated with many different types of engines for use in treating fuel. The size of the system can be further reduced in some embodiments by not including some components. For example, some embodiments do not include an impeller assembly and/or a biasing member. As such, the overall length can be significantly reduced while still providing fuel enhancement. The fuel enhancement systems of the present embodiments may be further understood in view of co pending U.S. patent application Ser. No. 11/405,507, filed May 27, 2005, to Erihsson et al., entitled METHOD AND APPARATUS FOR USE IN ENHANCING FUELS, incorporated herein by reference in its entirety, and U.S. Pat. Nos. 5,482,629 and 6,106,782, each of which is incorporated herein by reference in their entirety.

While the invention herein disclosed has been described by means of specific embodiments and applications thereof, numerous modifications and variations could be made thereto by those skilled in the art without departing from the scope of the invention set forth in the claims.

What is claimed is:

1. An apparatus for use in treating fuel, comprising:

a first conduit having an input end, an output end, and a metallic interior surface;

a second conduit positioned within and axially aligned with the first conduit, the second conduit having input and output ends, and a plurality of apertures distributed along a length of the second conduit; and an impeller assembly comprising an impeller positioned between an adaptor sleeve and shaft support where at least the impeller and shaft support are fixed within the second conduit, and the adaptor sleeve is positioned at the input end of the second conduit.

2. The apparatus of claim 1, wherein the impeller assembly further comprises:

an impeller shaft having a first end and a second end where the impeller is rotatably positioned along the impeller shaft, the first end of the impeller shaft is secured with the adaptor sleeve and the second end of the impeller shaft is secured with the shaft support.

3. The apparatus of claim 1, wherein the adaptor sleeve comprises a hollow cylindrical body that slideably extends about an exterior of the input end of the second conduit such that fluid flows into the second conduit through the adaptor sleeve.

4. The apparatus of claim 1, wherein the impeller assembly further comprises a friction sleeve positioned about and axially aligned with the shaft and extending through a central bore of the impeller such that the impeller is rotationally positioned about and axially aligned with the friction sleeve and the shaft.

5. The apparatus of claim 1, wherein the impeller assembly has a length that is less than the length of the second conduit such that the shaft support is positioned within the second conduit between the input and the output ends of the second conduit.

6. The apparatus of claim 1, further comprising:

a fluid treatment control bypass affixed with the second conduit configured to control an amount of fluid flow exiting the second conduit through the plurality of apertures distributed along the length of the second conduit.

7. An apparatus for use in enhancing fuel, comprising:

an exterior conduit;

an input and an output cooperate with opposite sides of the exterior conduit through which fuel enters and exits respectively;

a reaction cartridge assembly positioned within the exterior conduit to receive and at least induce cavitation of the fuel and outputting cavitated fuel; and biasing member positioned within the exterior conduit and cooperated with the reaction cartridge assembly to maintain a positioning of the reaction cartridge assembly;

wherein the reaction cartridge assembly comprises:

an outer conduit having an input end, an output end, and a metallic interior surface; and an inner conduit positioned within and axially aligned with the outer conduit, the inner conduit having first and second ends, and a plurality of holes distributed along at least a portion of a length of the inner conduit such that fuel received by the reaction cartridge assembly enters the inner conduit and is forced through the plurality of holes distributed along the portion of the length of the inner conduit inducing a first phase of the cavitation of the fuel.

8. The apparatus of claim 7, wherein the reaction cartridge assembly further comprises an impeller assembly that comprises an impeller positioned between an adaptor sleeve and shaft support where at least the impeller and shaft support are positioned within the inner conduit such that the impeller induces a second phase of the cavitation.

9. The apparatus of claim 8, further comprising:

a vortex positioned within the exterior conduit such that the fuel passes through the vortex inducing a third phase of the cavitation.

10. The apparatus of claim 7, wherein the reaction cartridge assembly further comprises a fuel treatment control bypass affixed with the inner conduit configured to control an amount of fuel exiting the inner conduit through the plurality of holes distributed along the portion of the length of the inner conduit.

11. The apparatus of claim 10, wherein the reaction cartridge assembly further comprises an end cap secured with the second end of the inner conduit where the end cap comprises at least a portion of the fuel treatment control bypass including a bypass aperture formed within the end cap such that a portion of the fuel supplied to the inner conduit passes through the bypass aperture exiting the inner conduit.

12. The apparatus of claim 10, wherein the fluid treatment control bypass comprises a bypass tube affixed at a first end to a bypass aperture of the inner conduit proximate the first end of the inner conduit and the bypass tube having a length extending along an exterior of the inner conduit.

13. The apparatus of claim 7, further comprising:

an impeller assembly comprising an impeller positioned between an adaptor sleeve and shaft support where at least the impeller and shaft support are fixed within the inner conduit.

14. The apparatus of claim 13, wherein the impeller assembly further comprises an impeller sleeve extending through a central bore of the impeller such that the impeller is rotationally positioned about and axially aligned with the impeller sleeve.

15. A method for use in manufacturing a fuel treatment apparatus, comprising:

assembling an impeller assembly;

inserting at least an impeller, a portion of an impeller shaft and an impeller shaft support of the impeller assembly into an inner conduit having a plurality of apertures distributed along a portion of a length of the inner conduit;

slideably engaging the assembled impeller assembly with the inner conduit;

inserting the inner conduit into an outer conduit having a diameter greater than a diameter of the inner conduit;

engaging at least a portion of the impeller assembly with the outer conduit; and securing the inner conduit with the outer conduit forming a reaction cartridge.

16. The method of claim 15, wherein the inserting of the impeller into the inner conduit comprising inserting the impeller into the inner conduit such that the impeller is positioned between an input end of the inner conduit and the plurality of apertures disturbed along the portion of the inner conduit.

17. The method of claim 15, further comprising:

inserting the reaction cartridge within an exterior sheath conduit;

securing an inlet to a first side of the exterior sheath conduit; and biasing the reactor cartridge within the exterior sheath conduit against the inlet.

18. The method of claim 15, further comprising:

securing a treatment control bypass to the inner conduit.

* * * * *